US005131314A

United States Patent [19]

Hansen et al.

[11] Patent Number: 5,131,314

[45] Date of Patent: Jul. 21, 1992

[54] METHOD OF ATTACHING CONICAL STAND-OFF TO A SUPPORT SURFACE

[75] Inventors: David N. Hansen, Murrysville; James D. Klingensmith, Apollo, both of Pa.

[73] Assignee: Aluminum Company of America, Pittsburgh, Pa.

[21] Appl. No.: 726,900

[22] Filed: Jul. 8, 1991

[51] Int. Cl.[5] ..... F41H 5/013

[52] U.S. Cl. ..... 89/36.02; 29/467; 29/525.1; 89/36.08; 109/79; 109/85

[58] Field of Search ..... 29/464, 467, 525.1; 89/36.02, 36.04, 36.08, 36.12; 109/79, 80, 85; 114/12

[56] References Cited

U.S. PATENT DOCUMENTS

| | | | |
|---|---|---|---|
| 2,283,484 | 5/1942 | Bak | 114/13 |
| 4,167,889 | 9/1979 | Bohne et al. | 89/36.02 |
| 4,398,446 | 8/1983 | Pagano et al. | 89/36.08 |
| 4,716,810 | 1/1988 | DeGuvera | 89/36.02 |
| 4,833,968 | 5/1989 | Bohne et al. | 89/36.08 |
| 4,905,569 | 3/1990 | Seksaria et al. | 89/36.02 |
| 5,033,357 | 7/1991 | Seksaria et al. | 89/36.04 |

*Primary Examiner*—Stephen C. Bentley

*Attorney, Agent, or Firm*—Earl M. Douglas; Elroy Strickland

[57] ABSTRACT

A method for attaching an applique panel to a support surface comprising securing a threaded stud to said support surface; placing a centering washer over said threaded stud such that said stud extends through the eyelet in said centering washer, and at least a portion of said centering washing is flush with said support surface; placing a hollow cone over said stud; placing an applique panel having an opening therein over the apex of said hollow cone such that said stud extends through said opening in said panel; placing an upper washer over said applique panel such that said stud extends through the eyelet in said upper washer; and placing a nut over the top of said threaded stud and rotating said nut thereby connecting and securing said upper washer, said applique panel, said hollow cone and said centering washer to said support surface.

13 Claims, 2 Drawing Sheets

METHOD OF ATTACHING CONICAL STAND-OFF TO A SUPPORT SURFACE

BACKGROUND OF THE INVENTION

1. Field of the Invention

The present invention relates generally to a method of securing and supporting items, such as applique (auxiliary) armor panels to an armored vehicle surface.

2. Description of the Prior Art

When an armored vehicle is hit by a projectile, the outer armor plate is damaged. Accordingly, such vehicles have been designed to include applique panels which provide additional protection against projectiles, and which can be readily removed and replaced.

Applique armor may be mounted on many types of military vehicles, as well as a multitude of other types of structures using spacer support systems. Over the years, the applique armor designed for such structures has been tailored for each application taking into account distinctive characteristics and operating conditions, such as ballistic loading, vibrations and noises, etc. In providing applique armor for each vehicle type, it is desirable that the system for attaching armor be capable of each adaptation and adjustment to a particular armor/vehicle system and its dynamic conditions. In particular, the method used for fastening applique armor to a vehicle must be light weight and engineered to meet load and shock requirements.

Over the years, a number of devices have been employed to hang armor on the surfaces of military vehicles. Examples of such devices are shown in U.S. Pat. No. 2,283,484 to Bak, U.S. Pat. No. 4,167,889 to Bohnue et.al., U.S. Pat. No. 4,716,810 to DeGuvera, and U.S. Pat. No. 4,833,968 to Bohnue et.al.

One means, in particular, for attaching applique armor panels involves the use of a stand-off cone. When the cone is made from the appropriate material, the triangular shape of the cone provides the needed geometric configuration to achieve a high strength-to-weight ratio. The preferred material for the cone include lightweight metals, such as aluminum, magnesium or titanium.

The strength of the stand-off cone is a function of both material strength and cross sectional properties, which include the cross sectional moment of inertia. Specifically, the moment of inertia increases at the forth power of the hollow cone's diameter. By increasing the diameter, one reduces significantly the amount of cone material needed to support items on a host surface. The consequent reduction in material leads to a reduction in weight.

There are various means for attaching such cones to the surface of the armored vehicle. One such fairly common method for hanging armor panels on military vehicles involves utilizing a cone which is attached to the hull of the vehicle by a centrally located stud or pin. Since the base of the cone could shift under transverse loading, the stud must be loaded in shear as well as tension. A design that could accommodate such a condition requires heavy cross sections of the stud. However, this reduces the weight efficiency. An alternative design must be provided which provides the needed loading without compromising weight efficiency.

Furthermore, the centrally located studs used in such designs are subjected to dynamic loads imparted by the weight of the armor when the vehicle is in motion. After repeated cycles, these loads cause the studs to bend or tear from the hull of the vehicle. A mounting scheme is need that is simple, cost effective, and includes a stabilizing feature to overcome this design fault.

SUMMARY OF THE INVENTION

It is therefore an object of the present invention to provide a method of attaching applique panels to a support surface that is cost effective, weight efficient, and capable of being easily adapted and adjusted to a particular armor/vehicle system and its dynamic conditions or other uses and their environments.

It is also an object of this invention to provide a design wherein an applique panel is attached using a centrally located stud that is loaded in shear as well as tension, without compromising weight efficiency.

It is a further object of this invention to provide a mounting method which provides a stabilizing feature to reduce loads imparted by the weight of the applique panel when the vehicle is in motion.

These and other objects are accomplished by providing a unique method for attaching an applique panel to a support surface by means of a centrally located stud or pin, a stand-off cone, and a centering washer that provides tolerance and prevents the complex loading of the stud. In addition, the base of the cone can be placed in a circular cavity included in the support surface. This cavity provides a true bearing surface enabling the cone to absorb impact or dynamic loads and transmit such loads away from the stud.

DETAILED DESCRIPTION

Figure 1:
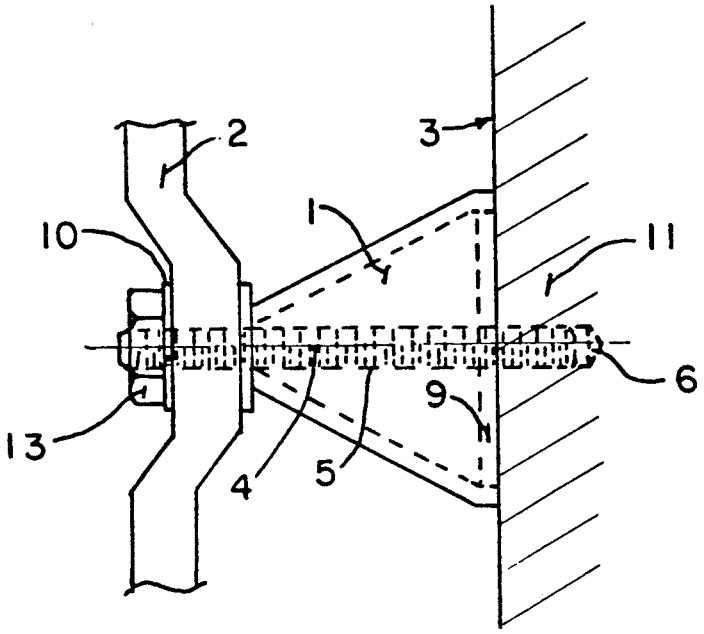
FIG. 1 is a cross-sectional view of an applique armor panel attached to an armored vehicle surface having a stand-off cone therebetween and a centering washer in accordance with one embodiment of the present invention.

Referring now to the drawings, and in particular FIG. 1, cone 1 is used to provide stand-off as well as structural support in mounting an applique panel 2 to the surface 3 of a host structure 11. Such cones are preferably fabricated from lightweight metals, such as aluminum, magnesium, or titanium.

Figure 2:
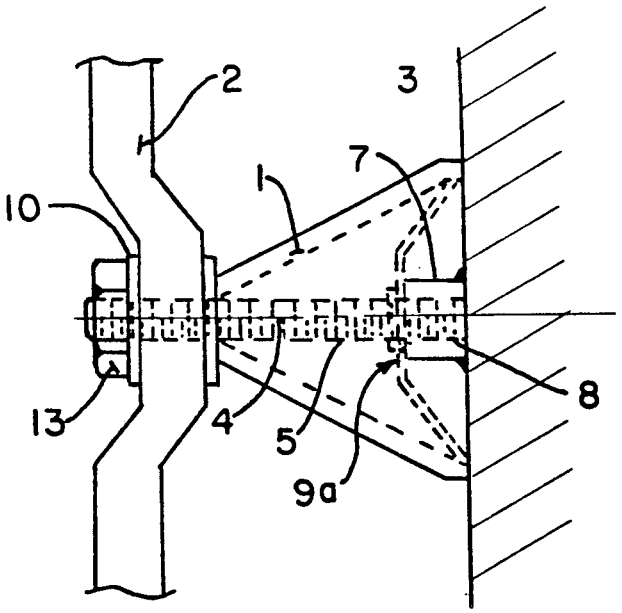
FIG. 2 is a cross-sectional view of an applique armor panel attached to an armored vehicle surface illustrating another embodiment of the centering washer of the present invention.
Figure 3:
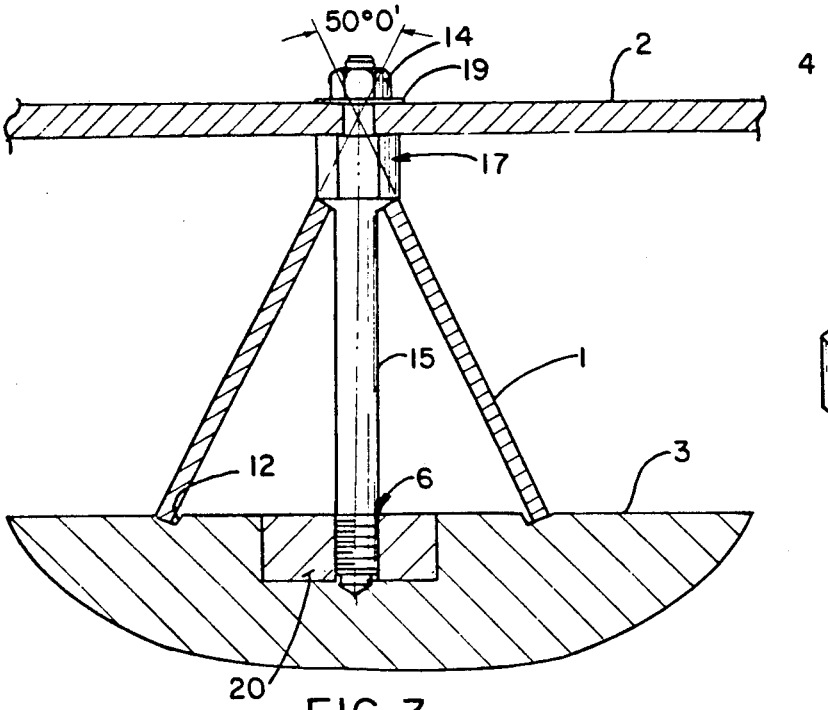
FIG. 3 is a cross-sectional view of an applique armor panel attached to an armored vehicle surface which includes a load bearing surface in accordance with the present invention.

In a preferred embodiment of the present invention, the host structure 11 is an armored vehicle and the support surface 3 is the hull of the armored vehicle. As illustrated in FIG. 1, the wall of cone 1 tapers between its base and apex ends, and encloses a central axis 4. An all-threaded stud 5 is used to anchor the applique panel 2 and cone 1 to the host structure 11. The host structure 11 includes a threaded mounting hole which is integral therewith. As shown in FIG. 1, a threaded mounting hole 6 for receiving and engaging threaded stud 5 can be drilled directly into the host structure 11. In an alternative embodiment, as illustrated in FIG. 2, a projection 7 can be affixed to and extend from support surface 3. The projection 7 includes a threaded mounting hole 8 therein for receiving and engaging all-threaded stud 5. The projection 7 may consists of any of a number of comment elements for engaging stud 5 such as a boss, a bracket, part of an insert, etc. In yet another embodiment of the present invention, as illustrated in FIG. 3, the threaded mounting hole 6 can be included in an insert 20, such as a Rosan insert. Such inserts provide a much larger bearing surface as compared to threading the stud or pin directly into the support surface 3. As such, if a projectile hits the outer end of the stud or pin, it will prevent the stud or pin from being driven through the support surface 3 and into the interior of the host structure.

In accordance with the first aspect of the present invention as illustrated in FIGS. 1 and 2, the applique panel 2 is mounted using a centering washer 9. The purpose of centering cone 1 is for both tolerances, as well as prevention of the complex loading of the stud 5. As illustrated in FIG. 2, if the support surface 3 includes a projection 7 for engaging the stud 5, the centering washer 9*a* can be contoured to lay flush with the surface of projection 7, and extend outward at an angle such that the perimeter of centering washer 9*a* is adjacent to the inner surface of the base of cone 1.

In accordance with this aspect of the present invention the applique panel 2 is mounted on the vertical side of the hull of a vehicle in the following manner. Referring to FIG. 1, threaded stud 5 is inserted into the mounting hole 6. Upon rotating the stud 5, the threads thereon engage the threads within the mounting hole 6, thereby attaching stud 5 to the support surface 3. The eyelet in centering washer 9 is aligned with stud 5, and centering washer 9 is placed over stud 5 such that stud 5 extends through the eyelet and centering washer 9 is flush with support surface 3 or projection 7. Cone 1 is placed over stud 5 such that its base is flush with support surface 3 and such that stud 5 extends through the central axis 4 of cone 1 and extends out from the apex end of cone 1. Cone 1 is concentric with the centering washer 9, and the perimeter of centering washer 9 is encompassed by and in close proximity to the inner surface of the base of cone 1. An applique panel 2 having a hole therein is placed over the apex of cone 1, such that stud 5 extends through the hole in panel 2. An upper washer 10 is then placed over the applique panel 2 such that stud 5 extends through the eyelet in washer 10. A nut 13 is placed over the top of stud 5, thereby securing upper washer 10, panel 2, cone 1, and centering washer 9 to support surface 3. The combined action of the centering washer 9 with cone 1 leads to a very light and efficient load bearing and spacing attachment method.

Figure 5:
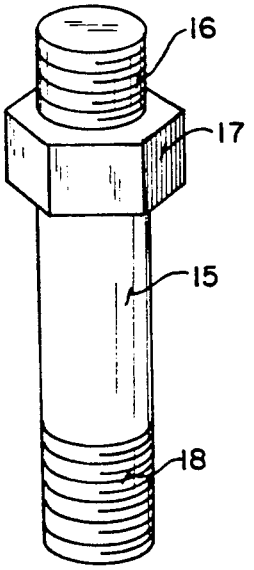
FIG. 5 is a perspective view of a pin used in accordance with one aspect of the present invention as illustrated in FIG. 3.
Figure 4:
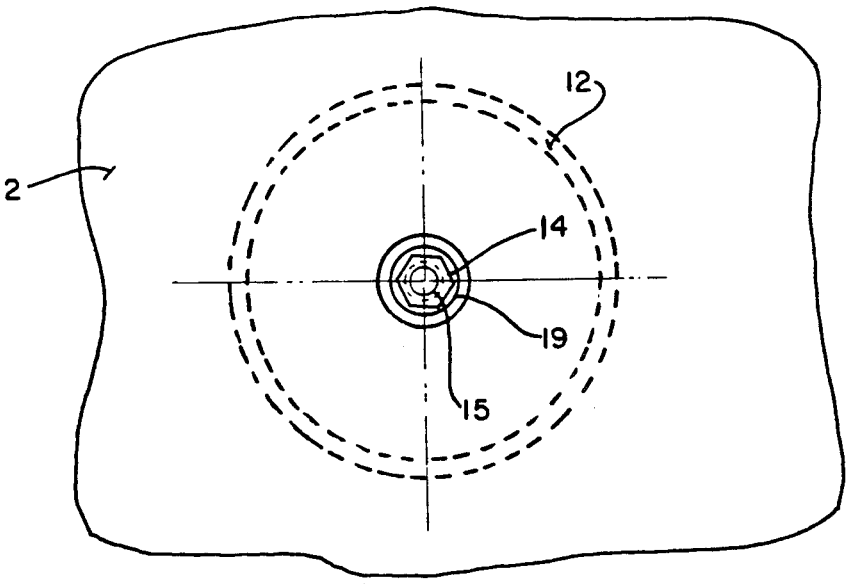
FIG. 4 is an overhead plan view taken along line 4—4 in FIG. 3.

Referring now to FIGS. 3 and 4, a second aspect of the present invention is illustrated. In accordance with this aspect of the invention, there is provided a cavity 12 within the support surface 3. Cavity 12 provides a true bearing surface which lies on a plane perpendicular to the axis of the threaded hole 6. There is further provided a pin 15 which secures a stand-off cone 1 to the support surface 3. As illustrated in FIG. 5, the upper end of Pin 15 includes a threaded shank 16 and a hexagonal section 17. The lower end of pin 15 includes a threaded portion 18.

In accordance with this aspect of the present invention, cone 1 is seated in the circular groove 12 which is provided in the support surface 3. The pin 15 is then inserted through the cone and threaded and tightened into the threaded hole 6 within the support surface 3. As with the previous embodiment, the threaded hole may be drilled directly into the support surface, include in an elevated projection, or included in an insert 20 as it is illustrated in FIG. 3. The auxiliary panel 2 is located on the outer threaded end 16 of the pin 15. A outer washer 19 and nut 14 are used to secure the panel 2 against the hexagonal section 17 of the pin 15.

Cone 1 stabilizes the end of pin 15 away from support surface 3. Impact or dynamic loads in all directions are absorbed by the cone 1, and transmitted to the support surface 3 away from the threaded hole 6, thereby limiting any bending of pin 15. The cavity 12 and cone 1 vastly improve the performance of the stand-off, permitting low cost hang-on armor installation.

In both embodiments, the cone 1 is kept in compression by the stud 5 or pin 15 thereby placing the stud or pin in tension. Such compression/tension provides a perfect isosceles triangle and thus a good structure for hanging and spacing auxiliary panels.

It should be understood that the load bearing cavity 12 can be used alone or in conjunction with the centering washer 10 described above. Furthermore, regardless of whether the centering washer and the load bearing cavity are used separately or in combination the applique panel 2 may be countersunk as illustrated in FIGS. 1 and 2 to provide flush mounting, or it may be flat as illustrated in FIGS. 3 and 4.

Although the invention set forth herein has been described for use with military armored vehicles, this system could be used for ornamental panel attachment as well as applique armor modules. In accordance with this embodiment, the head of the stud would be covered or replaced with an ornamental piece.

While the invention has been described in terms of preferred embodiments, the claims appended hereto are intended to encompass all embodiments which fall within the spirit of the invention.

What is claim is:

1. A method for attaching an applique panel to a support surface comprising:

securing a threaded stud to said support surface;

placing a centering washer over said threaded stud such that said stud extends through the eyelet in said centering washer, and at least a portion of said centering washer is flush with said support surface;

placing over said stud a hollow cone with an apex and a base, having an inlet at its apex, and a central axis extending from said inlet to said base, said hollow cone being positioned such that its base is flush with said support surface and said stud extends through said central axis and projects from said apex, said hollow cone being further positioned such that it is concentric with said centering washer, and the perimeter of said centering washer is within and in close proximity to the interior surface of said base of said cone;

placing an applique panel having an opening therein over said apex of said hollow cone such that said stud extends through said opening in said panel;

placing an upper washer over said applique panel such that said stud extends through the eyelet in said upper washer; and placing a nut over the top of said threaded stud an rotating said nut thereby connecting and securing said upper washer, said applique panel, said hollow cone and said centering washer to said support surface.

2. An article produced by the method of claim 1.

3. The method of claim 1, wherein said support surface is an armored vehicle hull and said applique panel is an applique armor panel.

4. The method of claim 1, wherein a threaded hole is integral with said support surface and said threaded stud is secured to said support surface by inserting said threaded stud into said threaded hole and rotating said stud.

5. The method of claim 4, wherein said threaded hole is defined by a projection extending from the surface of said support surface.

6. The method of claim 4, wherein said threaded hole is included in an insert.

7. The method of claim 5, wherein said lower washer is contoured to lay flush with the upper surface of said projection.

8. The method of claim 1, wherein said applique panel is countersunk.

9. A method for attaching an applique panel to a support surface comprising:

placing over said support surface a hollow cone, said support surface having a threaded hole which is integral therewith, and a circular cavity located therein which is concentric with and surrounds said threaded hole, said hollow cone having an apex with an inlet, a circular base, and a central axis extending from said inlet to said base, said circular base being congruent with and inserted into said circular cavity such that said central axis is aligned with said threaded hole;

placing a pin having a threaded shank and a hexagonal section on its upper end and a threaded portion on its lower end through the inlet at the apex of said hollow cone and along the central axis therein, and into said threaded hole;

rotating said pin such that the threads on said lower end of said pin engage the treads in said hole, thereby connecting and securing said hollow cone to said support surface;

placing an applique panel having an opening therein over said upper end of said pin such that said threaded shank extends through said opening in said panel and said panel is flush with said hexagonal section of said pin; and placing a nut over the top of said pin an rotating said nut thereby connecting and securing said applique panel and said hollow cone to said support surface.

10. The article produced by the method of claim 9.

11. The method of claim 9, wherein said support surface is an armored vehicle hull and said applique panel is an applique armor panel.

12. The method of claim 9, wherein said threaded hole is defined by a projection extending from the surface of said support surface.

13. The method of claim 9, wherein said applique panel is countersunk.

* * * * *